US007802380B2

(12) United States Patent
Riebesell

(10) Patent No.: US 7,802,380 B2
(45) Date of Patent: Sep. 28, 2010

(54) SHOE CONSTRUCTION WITH DOUBLE TONGUE

(75) Inventor: Noemi Riebesell, Clinton, MA (US)

(73) Assignee: Converse Inc., North Andover, MA (US)

( * ) Notice: Subject to any disclaimer, the term of this patent is extended or adjusted under 35 U.S.C. 154(b) by 781 days.

(21) Appl. No.: 11/536,422

(22) Filed: Sep. 28, 2006

(65) Prior Publication Data

US 2008/0078104 A1 Apr. 3, 2008

(51) Int. Cl.
*A43B 13/14* (2006.01)
*A43B 23/26* (2006.01)

(52) U.S. Cl. ..... 36/99; 36/54

(58) Field of Classification Search ..... 36/99, 36/54, 45, 109, 55
See application file for complete search history.

(56) References Cited

U.S. PATENT DOCUMENTS 1,355,323 A * 10/1920 Fox ..... 36/54
3,906,646 A 9/1975 Milotic
5,946,826 A 9/1999 Merle et al.
6,895,696 B1 5/2005 Sanders
6,993,860 B2 * 2/2006 Bettiol ..... 36/54
2002/0170205 A1 * 11/2002 Shepherd ..... 36/54
2003/0000111 A1 * 1/2003 Basso ..... 36/55

OTHER PUBLICATIONS

ISA Patent Cooperation Treaty, International Search Report of PCT/US07/79640,Apr. 11, 2008, 1 page.

* cited by examiner

*Primary Examiner*—Ted Kavanaugh
(74) *Attorney, Agent, or Firm*—Shook, Hardy & Bacon LLP

(57) ABSTRACT

A novel shoe construction provides a unique aesthetically pleasing appearance to a shoe while also reinforcing the shoe construction. In the shoe construction, the shoe is provided with a first tongue that extends upwardly from the shoe sole and across the forefoot opening in the front of the shoe upper, and a second tongue that is separate from the first tongue and extends upwardly from the shoe sole beneath the first tongue.

19 Claims, 3 Drawing Sheets

SHOE CONSTRUCTION WITH DOUBLE TONGUE

BACKGROUND OF THE INVENTION (1) Field of the Invention

The present invention pertains to a novel shoe construction that provides a unique aesthetically pleasing appearance to a shoe while also reinforcing the shoe construction. In particular, the present invention pertains to a shoe construction in which the shoe is provided with a first tongue that extends upwardly from the shoe sole and across the forefoot opening in the front of the shoe upper, and a second tongue that is separate from the first tongue and extends upwardly from the shoe sole beneath the first tongue.

(2) Description of the Related Art

The oxford lace-up basketball shoe has been a very popular shoe for athletics for many years. In more recent years, in addition to the use of the shoe in athletics, the shoe has also become very popular as a comfortable casual shoe that has an aesthetically pleasing appearance. Shoes of this type are known as athleisure shoes. This is particularly true of the oxford lace-up basketball shoe that has an upper constructed of a flexible, breathable fabric, for example canvas.

With the increasing popularity of the oxford basketball shoe or athleisure shoes in general, new appearances have been sought for the shoe to maintain the marketability of the shoe by keeping up with the latest trends in fashion. However, in order to maintain the comfortable construction of the oxford-type shoe, changes to the shoe to keep up with fashion trends have been limited to changes in the color or pattern of the fabric employed in manufacturing the shoe. However, the colors or patterns of material employed in constructing the shoe are limited, creating a need to provide a new and aesthetically pleasing appearance of the shoe without detracting from the comfortable construction of the shoe.

SUMMARY OF THE INVENTION

The present invention overcomes the problem of providing a new and aesthetically pleasing appearance of an oxford lace-up basketball shoe without detracting from the comfortable construction of the shoe, and while actually reinforcing the construction of the shoe. The invention provides a novel modification to the shoe construction without substantially changing the original shoe construction. The athleisure shoe of the invention has basically the same construction as the popular oxford lace-up basketball shoe, but with an additional inner tongue that is positioned beneath the traditional tongue of the shoe and provides a new, aesthetically pleasing appearance for the shoe.

The shoe construction of the present invention has a shoe sole that is substantially the same as the shoe sole employed in the construction of a typical athleisure shoe, for example a basketball oxford. The shoe construction of the invention also includes an upper that extends upwardly from the shoe sole to a top edge of the upper. The top edge of the upper defines a forefoot opening of the shoe and an ankle opening of the shoe that provide access to the shoe interior for the shoe wearer's foot. A tongue also extends upwardly from the shoe sole through the forefoot opening. An adjustable fastener, preferably lacing, extends across the forefoot opening and adjustably secures together the opposite sides of the upper over the tongue and the shoe wearer's foot by tightening and tying the lacing, all of which are conventional.

The novel construction of the shoe of the invention is provided by a second, inner tongue that extends upwardly from the shoe sole. The second tongue extends upwardly beneath the first, conventional tongue of the shoe. The inner, second tongue has basically the same configuration as the first, outer tongue and extends upwardly from the sole to the same extent as the outer tongue. In addition, the second, inner tongue is left unattached to the first, outer tongue, except for the connections of the two overlapping tongues at the shoe sole and the toe cap of the shoe.

Thus, the shoe construction with the double, overlapping tongues gives the shoe a novel aesthetically pleasing appearance without detracting from the comfortable construction of the shoe. Furthermore, by providing the first and second tongues, the shoe construction in the area of the lacing is reinforced by the double overlapping tongues.

BRIEF DESCRIPTION OF THE DRAWINGS

Further features of the invention are set forth in the following detailed description of the preferred embodiment of the invention and in the drawing figures.

DETAILED DESCRIPTION OF THE PREFERRED EMBODIMENT

Figure 1:
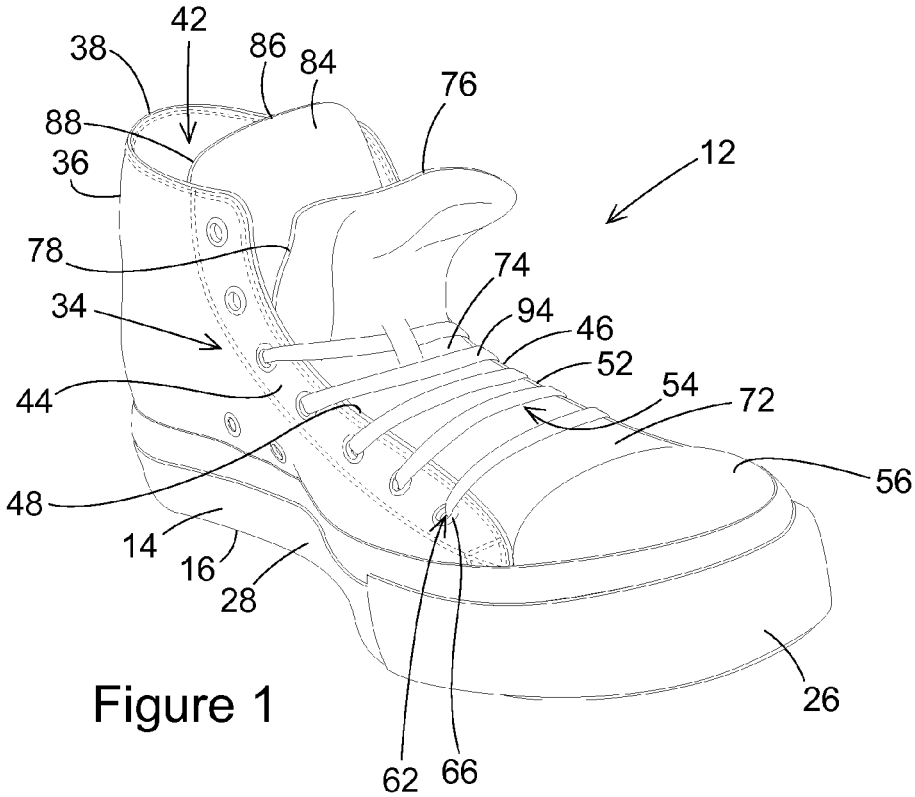
FIG. 1 is a perspective view of the front of a left shoe of the invention, with the right shoe of the invention having a construction that is a mirror image duplicate of the left shoe construction.
Figure 2:
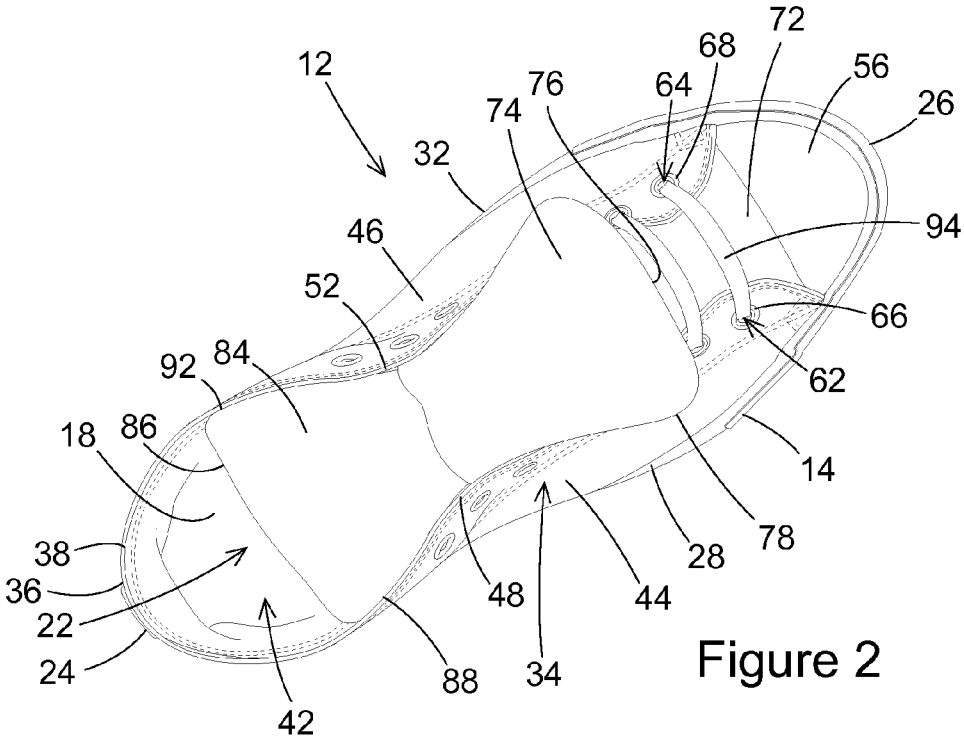
FIG. 2 is a top plan view of the shoe shown in FIG. 1.
Figure 3:
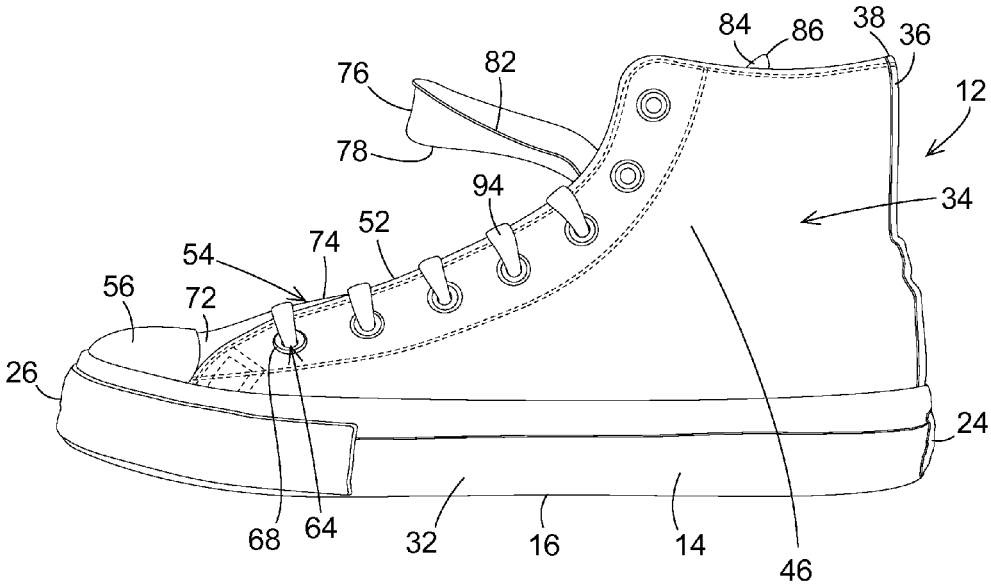
FIG. 3 is a left side elevation view of the shoe shown in FIG. 1.
Figure 4:
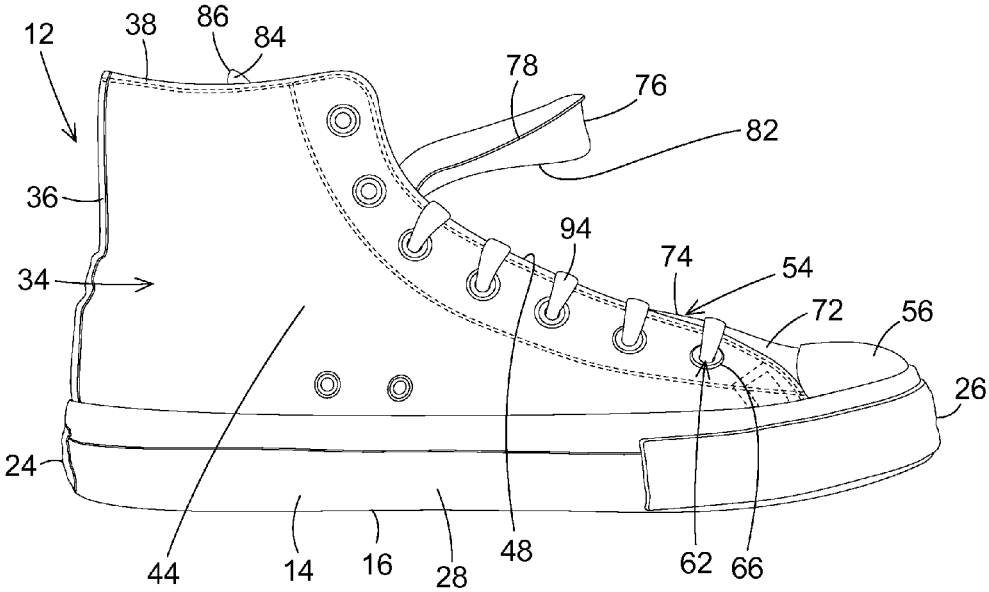
FIG. 4 is a right side elevation view of the shoe shown in FIG. 1.
Figure 5:
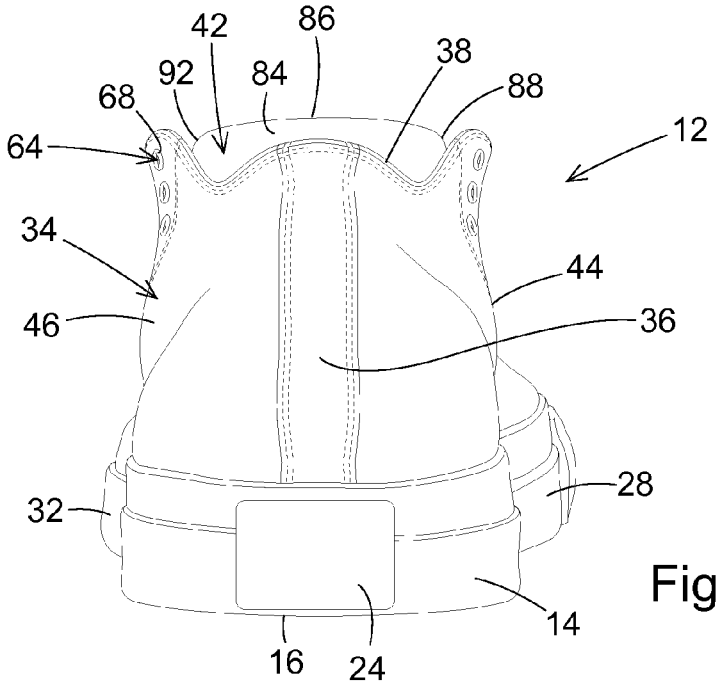
FIG. 5 is a rear elevation view of the shoe shown in FIG. 1.
Figure 6:
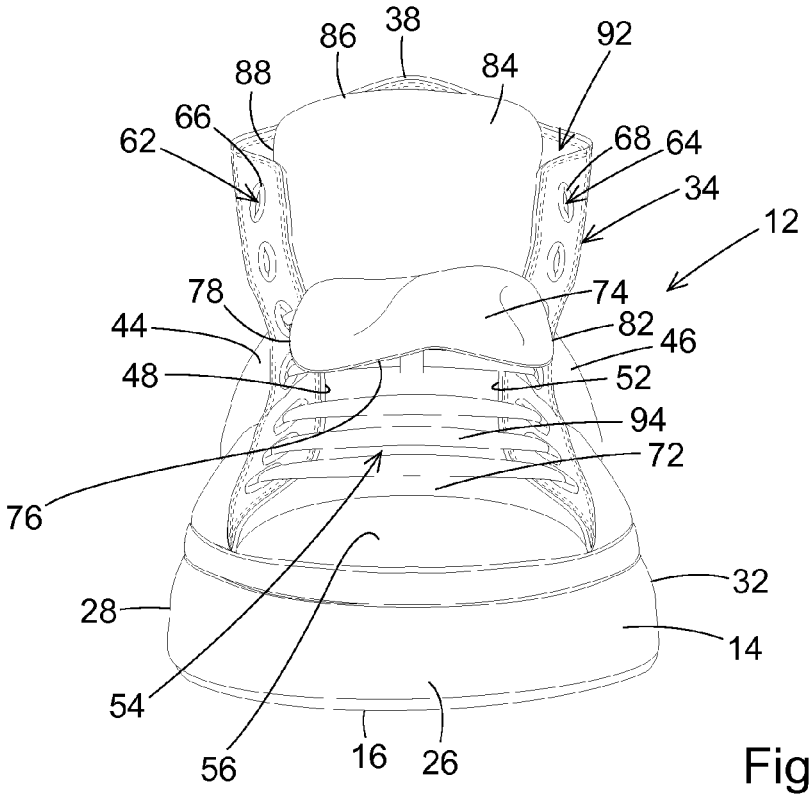
FIG. 6 is a front elevation view of the shoe shown in FIG. 1.

The double tongue construction of the athleisure shoe 12 of the present invention has the basic construction of an oxford lace-up basketball shoe. The exception is that the novel construction of the shoe 12 provides the shoe with a second, inner tongue that is separate from the first, outer tongue of the shoe. This provides the shoe with a unique, aesthetic appearance, and reinforces the shoe by providing a double layer of flexible material on the shoe in the area of the shoe lacing. In the preferred embodiment of the shoe 12 shown in the drawing figures, the shoe is a high-top oxford basketball shoe. However, it should be understood that the novel concept of the invention could be employed on other types of shoes. Because much of the construction of the shoe 12 of the invention is the same as that of a conventional oxford lace-up shoe, the conventional features of the construction will be described only generally herein.

The shoe 12 has a shoe sole 14 that is constructed of resilient materials that are typically employed in the construction of soles of athletic shoes. The sole 14 can be constructed with an outsole, a midsole, and an insert, as is conventional. The shoe sole 14 has a bottom surface 16 that functions as the traction surface of the shoe, and an opposite top surface 18 in the interior 22 of the shoe. The size of the shoe 12 has a length that extends from a rear heel end 24 to a front toe end 26 of the sole, and the shoe 12 has a width that extends between a right side 28 and a left side 32 of the shoe sole.

The shoe upper 34 is secured to the shoe sole 14 and extends upwardly from the shoe sole top surface 18, as is conventional. The upper 34 is constructed of a flexible material, for example leather or a fabric such as canvas. The upper 34 is constructed with a heel portion 36 that extends around the shoe sole top surface 18 at the shoe sole heel end 24. The upper heel portion 36 extends upwardly from the shoe sole 18 to a collar edge 38 of the upper that defines an ankle opening 42 into the shoe interior 22.

From the heel portion 36, the upper 34 has a right side portion 44 and a left side portion 46 that extend forwardly along the respective shoe sole right side 28 and shoe sole left side 32. The upper right side portion 44 extends upwardly from the shoe sole right side 28 to an upper right side edge 48. The upper left side portion 46 extends upwardly from the shoe sole left side 32 to an upper left side edge 52. As seen in the drawing figures, the upper right side edge 48 and the upper left side edge 52 extend forwardly from opposite sides of the upper collar edge 38 toward the front toe end 26 of the shoe sole. The length of the upper right side edge 48 and the upper left side edge 52 define a forefoot opening 54 in the shoe upper 34 that opens to the shoe interior 22.

The upper 34 is also constructed with a toe box or toe cap 56 that extends around and across the shoe sole top surface 18 at the shoe sole toe end 26. The toe box 56 is connected between the upper right side portion 44 and the upper left side portion 46 and encloses a portion of the shoe interior 22 adjacent the shoe sole toe end 26. The upper right side edge 48 and the upper left side edge 52 extend rearwardly from the toe box 56.

A first plurality of apertures 62 are provided on the upper right side portion 44 and a second plurality of apertures 64 are provided on the upper left side portion 46. The apertures 62, 64 are preferably lacing openings, meaning openings on the shoe upper that are typically occupied by a portion of the lacing that closes the shoe upper over the forefoot opening of the shoe. The apertures 62, 64 can be provided by any known means of providing lacing openings on shoes, for example D-rings or speed lacing hooks. However, in the preferred embodiment of the invention, the apertures 62, 64 are provided by a first plurality of eyelets or grommets 66 on the upper right side portion 44 and a second plurality of eyelets or grommets 68 on the upper left side portion 46. The eyelets 66, 68 provide the desired conventional lace-up shoe appearance. The apertures 62, 64 are arranged in lines along the upper right side edge 48 and along the upper left side edge 52, as is conventional. As is seen in the drawing figures, the apertures 62, 64 extend substantially the entire lengths of the upper right side edge 48 and the upper left side edge 52 between the upper collar edge 38 and the upper toe box 56.

The shoe upper 34 includes a vamp 72 or throat positioned rearwardly of the toe box 56, and a tongue 74 that extends rearwardly from the vamp 72 through the forefoot opening 54. The tongue 74 extends along the lengths of the upper right side portion 44 and the upper left side portion 46 to a distal end 76 of the tongue. The tongue 74 has a width between a right side edge 78 and a left side edge 82 of the tongue. The length and width of the tongue position the tongue side edges beneath the upper right side portion 44 and the upper left side portion 46, respectively, and extend the tongue over the forefoot opening 54 of the shoe.

The construction of the shoe 12 to this point has been, for the most part, conventional. The unique shoe construction of the invention is provided by a second, inner tongue 84 that is also secured to the shoe sole 14 and extends upwardly from the shoe sole top surface 18 underneath the first, outer tongue 74. The second, inner tongue 84 is constructed in the same manner as the first, outer tongue 74. The inner tongue 84 also includes a vamp (not shown) that has the same configuration as the vamp 72 on the exterior of the shoe and underlies and coincides with the vamp 72 on the exterior of the shoe. The vamp of the second, inner tongue 84, like the exterior vamp 72, is secured to the shoe sole 14 around the toe end 26 of the sole, and is secured to the interior surface of the toe box 56. The second, inner tongue 84 extends rearwardly from the inner vamp (not shown) through the forefoot opening 54. The second tongue 84 extends along the lengths of the upper right side portion 44 and the upper left side portion 46 to a distal end 86 of the second tongue 84. As the second tongue 84 extends rearwardly from the inner vamp, the second tongue 84 is entirely separate from the first tongue 74 along the entire length of the second tongue. The second tongue 84 has a width dimension between a right side edge 88 and a left side edge 92 of the tongue. The length and width dimensions of the second tongue 84 are the same as those of the first tongue 74. In addition, the second tongue 84 is constructed of a flexible material, for example leather or fabric, as is the first tongue 74. To improve the appearance of the shoe 12, the second tongue 84 can be constructed of a material having a different visual appearance than that of the first tongue 74, for example, having a different color, or being constructed of a different material than the first tongue 74.

Adjustable fasteners extend across the forefoot opening 54 and across the two separate tongues 74, 84 positioned in the forefoot opening of the shoe. The adjustable fasteners adjustably connect the upper right side portion 44 with the upper left side portion 46. In the preferred embodiment of the invention, the adjustable fasteners are provided in the form of a shoe lacing 94. The lacing 94 is threaded through the right eyelet apertures 62 and left eyelet apertures 64 in any conventional manner. The lacing 94 preferably extends across the forefoot opening 54 and across the double layers of the two tongues 74, 84. The double layers of material provided by the two tongues 74, 84 provide reinforcement in the shoe construction in the area of the lacing 94. To alter the aesthetic appearance of the shoe, the lacing 94 could be threaded up across the forefoot opening 54 through only a portion of the eyelet apertures 62, 64. This enables the two tongues 74, 84 to be separated from each other to visually display both tongues when wearing the shoe. This configuration is shown in FIG. 1 where the first, outer tongue 74 is partially folded over the lacing 94 exposing the second, inner tongue 84 beneath the first tongue. Although the lacing 94 is preferred as the adjustable fasteners used with the shoe, other equivalent fasteners known in the art and used with shoes, for example, elastic bands or hook and loop-type straps, may also be used.

Although the shoe of the invention has been described above by referring to a particular embodiment of the shoe, it should be understood that the modifications and variations could be made to the shoe described without departing from the intended scope of protection provided by the following claims.

The invention claimed is:

1. A shoe construction comprising:

a sole having a toe end and an opposite heel end and having opposite right and left sides extending between the toe end and the heel end;

an upper of flexible material attached to the sole, the upper extending upwardly from the sole to a top edge of the upper, the upper top edge defining a forefoot opening and an ankle opening into an interior of the shoe inside the upper;

a first tongue of flexible material attached to the sole, the first tongue having a length that extends upwardly from the sole and through the forefoot opening to a distal end of the first tongue positioned at the ankle opening;

a second tongue of flexible material attached to the sole, the second tongue having a length that extends upwardly from the sole and through the forefoot opening to a distal end of the second tongue positioned at the ankle opening, the second tongue being separate from the first tongue along the length of the second tongue enabling the first and second tongues to be moved separately from each other; and the first tongue having opposite side edges and the second tongue having opposite side edges, with the opposite side edges of the first tongue overlapping and coinciding with the opposite side edges of the second tongue, allowing the opposite side edges of first tongue to have an unobstructed overlapping relationship with the opposite side edges of the second tongue.

2. The shoe construction of claim 1, further comprising:

a first plurality of apertures arranged in a line on one side of the forefoot opening and a second plurality of apertures arranged in a line on an opposite side of the forefoot opening; and, at least one adjustable fastener extending between the first plurality of apertures and the second plurality of apertures across the forefoot opening and across the first and second tongues.

3. The shoe construction of claim 2, further comprising:

the at least one adjustable fastener being lacing that extends through apertures of both the first plurality of apertures and the second plurality of apertures; and, both the first and second tongues being positioned between the shoe interior and the lacing.

4. The shoe construction of claim 2, further comprising:

the lengths of both the first and second tongues extend entirely through the forefoot opening.

5. The shoe construction of claim 1, further comprising:

the first tongue and second tongue having substantially equal widths and the first tongue and the second tongue having substantially equal lengths.

6. The shoe construction of claim 1, further comprising:

the first tongue having a distal end edge and the second tongue having a distal end edge where the distal end edge of the first tongue overlaps and coincides with the distal end edge of the second tongue.

7. The shoe construction of claim 1, further comprising:

the first tongue and the second tongue having different visual appearances.

8. The shoe construction of claim 1, further comprising:

the first tongue and the second tongue being constructed of different materials.

9. The shoe construction of claim 1, further comprising:

the first tongue having a distal end edge at the distal end of the first tongue; and, the second tongue having a distal end edge at the distal end of the second tongue, the second tongue side edges being separate from the first tongue side edges and the second tongue distal end edge being separate from the first tongue distal end edge.

10. A shoe construction comprising:

a sole having a toe end and an opposite heel end and having opposite left and right sides that extend between the toe end and the heel end;

an upper of flexible material attached to the sole, the upper having a right side portion extending upwardly from the sole right side, a heel portion extending upwardly from the sole heel end, and a left side portion extending upwardly from the sole left side, the upper right side portion and left side portion defining a forefoot opening to an interior of the shoe between the right side portion and the left side portion;

a vamp of flexible material attached to the sole right side and left side, the vamp defining a bottom end of the forefoot opening;

a first tongue of flexible material attached to the vamp, the first tongue having a length with opposite right and left side edges, the first tongue length extends from the vamp and through the forefoot opening to a distal end edge of the first tongue positioned at an opposite end of the first tongue length from the vamp;

a second tongue of flexible material beneath the first tongue, the second tongue having a length with opposite right and left side edges that are separate along the length of the second tongue from the first tongue right and left side edges, the second tongue length extends through the forefoot opening to a distal end edge of the second tongue that is separate from the distal end edge of the first tongue, the second tongue being separate from the first tongue enabling the first and second tongues to be moved separately from each other; and, the opposite side edges of the first tongue overlapping and coinciding with the opposite side edges of the second tongue, allowing the opposite side edges of first tongue to have an unobstructed overlapping relationship with the opposite side edges of the second tongue.

11. The shoe construction of claim 10, further comprising:

the first tongue being movable along the first tongue length separately from the second tongue.

12. The shoe construction of claim 11, further comprising:

a first plurality of apertures arranged in a line on one side of the forefoot opening and a second plurality of apertures arranged in a line on an opposite side of the forefoot opening; and, at least one adjustable fastener extending between the first plurality of apertures and the second plurality of apertures across the forefoot opening and across the first and second tongues.

13. The shoe construction of claim 12, further comprising:

the at least one adjustable fastener being lacing that extends through apertures of both the first plurality of apertures and the second plurality of apertures; and, both the first and second tongues being positioned between the shoe interior and the lacing.

14. The shoe construction of claim 10, further comprising:

the lengths of both the first and second tongues extend entirely through the forefoot opening.

15. The shoe construction of claim 10, further comprising:

the first tongue and second tongue having substantially equal widths and the first tongue and the second tongue having substantially equal lengths.

16. The shoe construction of claim 10, further comprising:

the first tongue and the second tongue having different visual appearances.

17. The shoe construction of claim 10, further comprising:

the first tongue and the second tongue being constructed of different materials.

18. The shoe construction of claim 10, further comprising:

the first tongue material being an extension of the vamp material.

19. The shoe construction of claim 10, further comprising:

the first tongue right side and left side edges and the second tongue right side and left side edges being positioned between the shoe interior and the respective right side portion and left side portion of the upper.

* * * * *